United States Patent [19]

Hoppe

[11] Patent Number: 4,606,291

[45] Date of Patent: Aug. 19, 1986

[54] CATAMARAN WITH HYDROFOILS

[75] Inventor: Karl-Günther W. Hoppe, Somerset-West, South Africa

[73] Assignee: Universiteit Van Stellenbosch, Stellenbosch, South Africa

[21] Appl. No.: 492,703

[22] Filed: May 9, 1983

[30] Foreign Application Priority Data

May 19, 1982 [ZA] South Africa ..... 82/3455

[51] Int. Cl.[4] ..... B63B 1/12

[52] U.S. Cl. ..... 114/61; 114/274; 114/280

[58] Field of Search ..... 114/61, 123, 274, 278, 114/280, 283, 288, 292

[56] References Cited

U.S. PATENT DOCUMENTS

| | | | |
|---|---|---|---|
| 2,890,672 | 6/1959 | Boericke | 114/274 |
| 3,221,697 | 12/1965 | Allegretti | 114/274 |
| 3,417,722 | 12/1968 | O'Neill | 114/280 |
| 3,547,063 | 12/1970 | Follett | 114/274 |
| 4,056,074 | 11/1977 | Sachs | 114/280 |

FOREIGN PATENT DOCUMENTS

| | | | |
|---|---|---|---|
| 51073 | 5/1982 | European Pat. Off. | 114/274 |
| 2060607 | 9/1979 | Fed. Rep. of Germany | 114/274 |
| 1523480 | 5/1968 | France | 114/274 |
| 142776 | 11/1981 | Japan | 114/274 |
| 5400 | 2/1982 | South Africa . | |
| 1524938 | 9/1978 | United Kingdom | 114/274 |
| 2088290 | 6/1982 | United Kingdom | 114/274 |

*Primary Examiner*—Galen L. Barefoot
*Assistant Examiner*—Stephen P. Avila
*Attorney, Agent, or Firm*—Larson and Taylor

[57] ABSTRACT

The invention discloses a catamaran type boat having two similar boat demi-hulls which are spaced apart and which are substantially parallel, each demi-hull having a base line (BL). The boat further includes a superstructure connecting the two demi-hulls transversely; an open space in the form of a tunnel defined between the superstructure and the two demi-hulls; a longitudinal center of gravity position (LCG) for the boat; at least one trim hydrofoil having a chord line (CL) extending between its leading edge and trailing edge and being located in the stern region of the boat and extending at least partially across the tunnel; and an attachment element for attaching all hydrofoils to the demi-hulls substantially along a transverse plane (TP) which is substantially at right angle to the longitudinal vertical center plane of the boat, and having an angle of between 1° and 7° to the base line (BL) of the demi-hulls at the main foil, and with the hydrofoil chord lines (CL) being at an angle of between 0° and 6° to the transverse plane (TP).

20 Claims, 30 Drawing Figures

FIG. 1
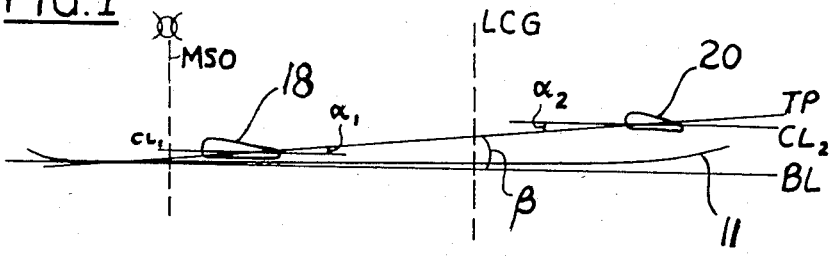
FIG. 3
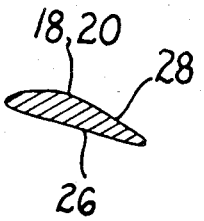
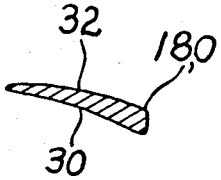
FIG. 4
FIG. 7
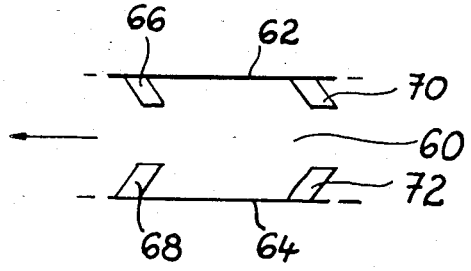
FIG. 8
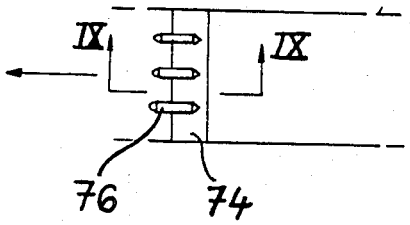

Figure 5A:
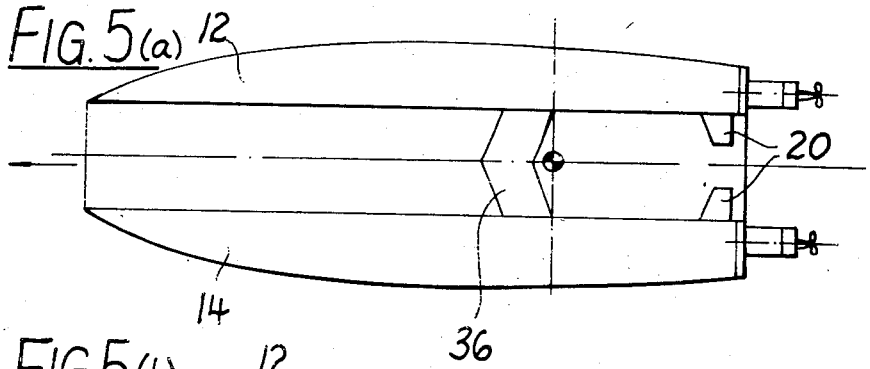
Figure 5B:
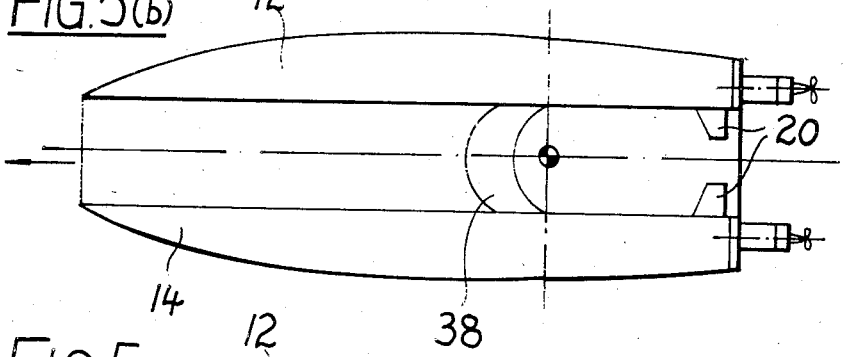
Figure 5C:
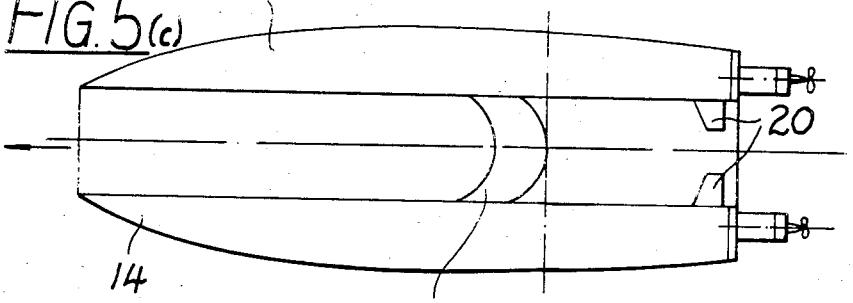
Figure 5D:
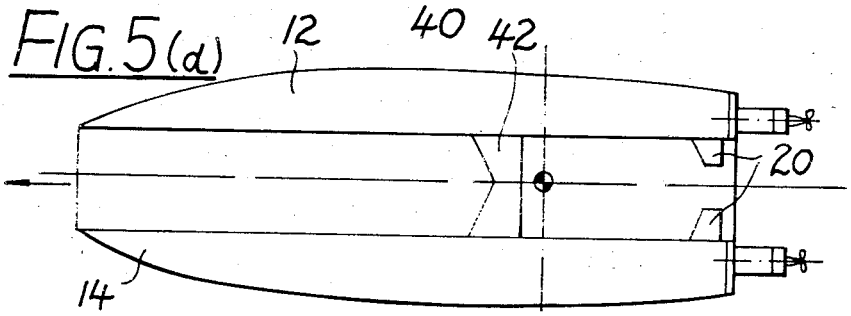

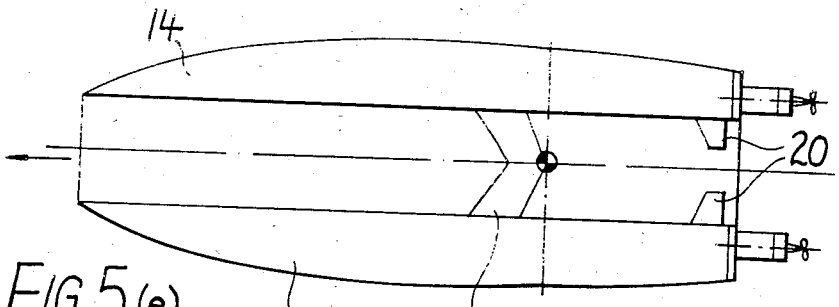
FIG. 5(e)
FIG. 5(f)
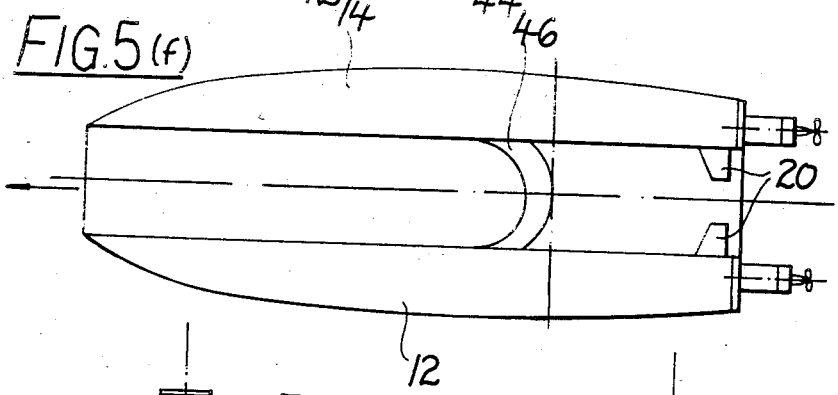
FIG. 6(a)
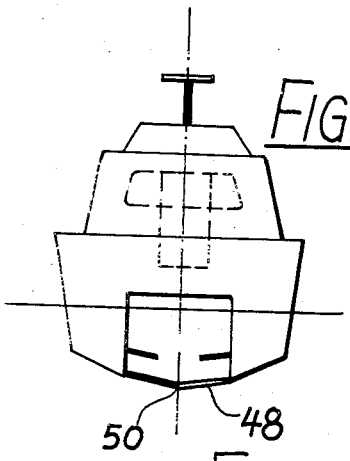
FIG. 6(c)
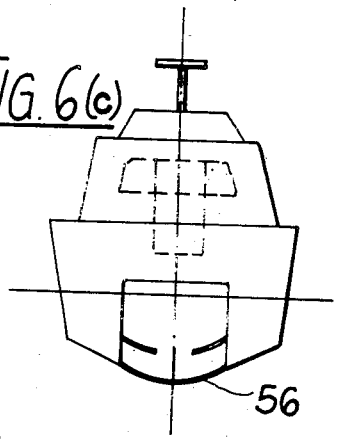
FIG. 6(b)
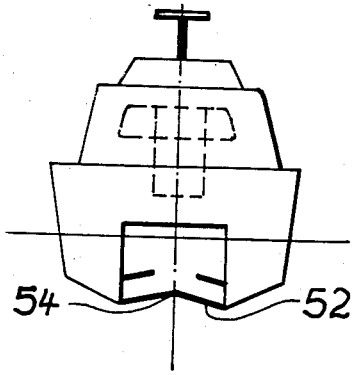
FIG. 6(d)
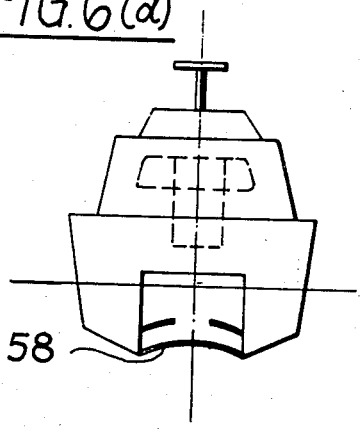

FIG.10
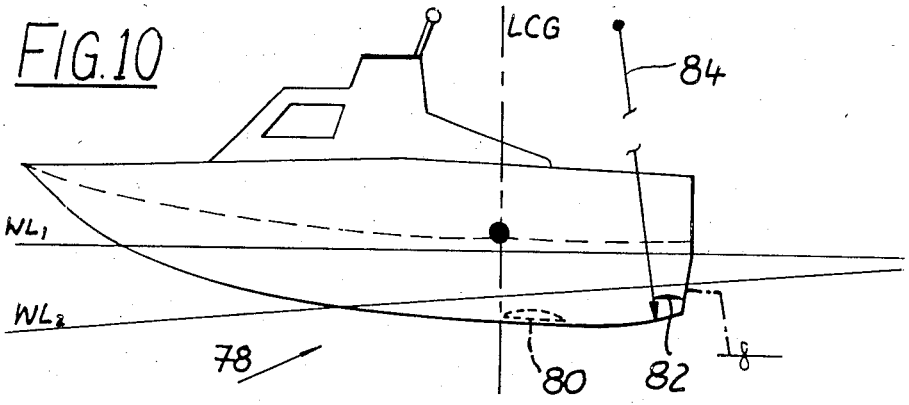
FIG.11
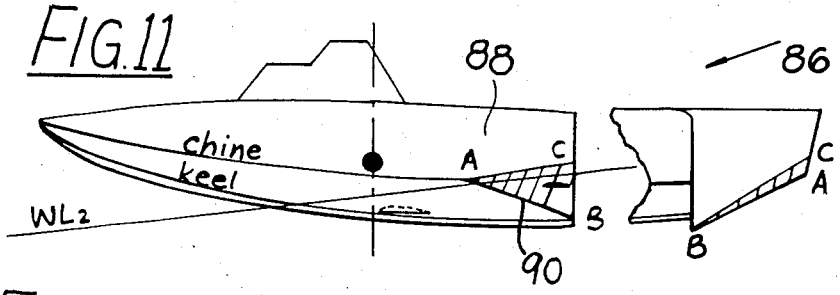
FIG.12
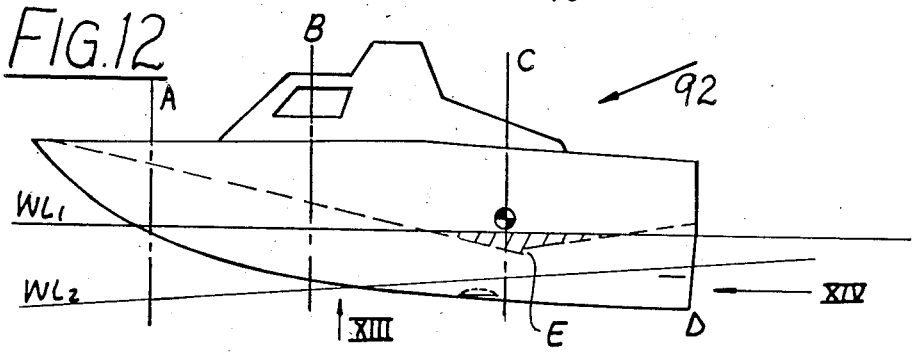
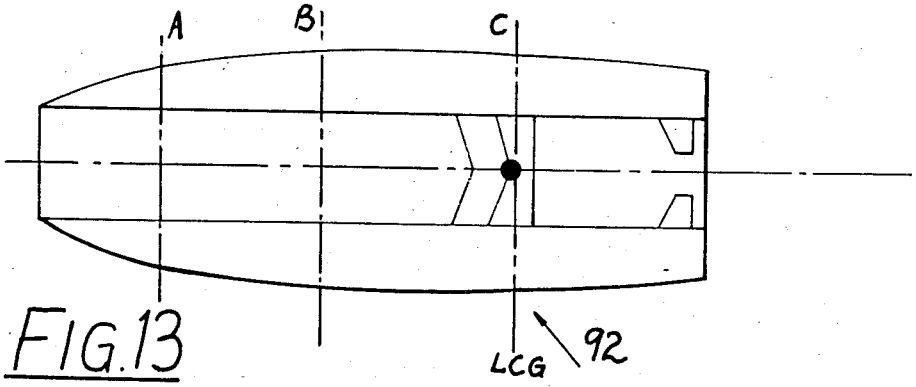
FIG.13

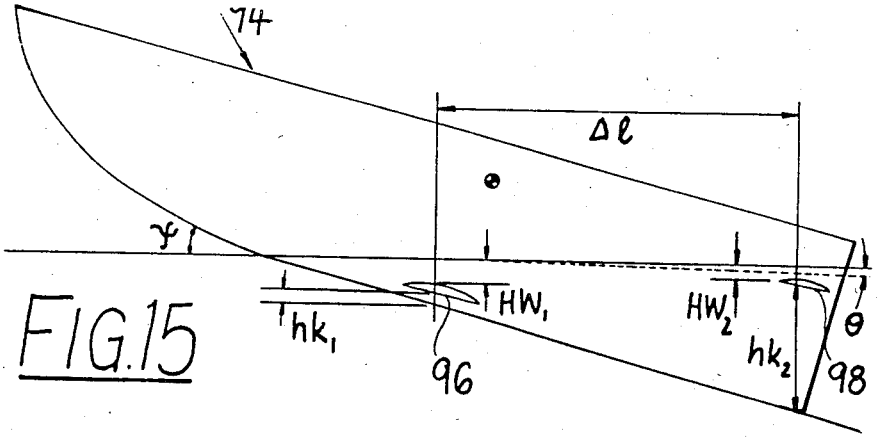
FIG.15
FIG.16
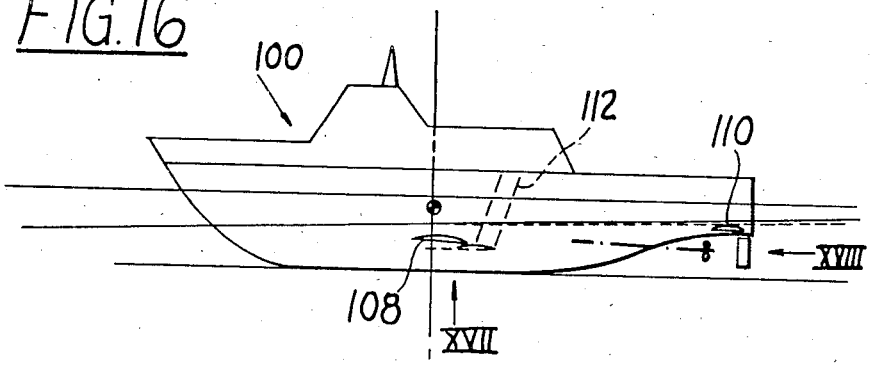
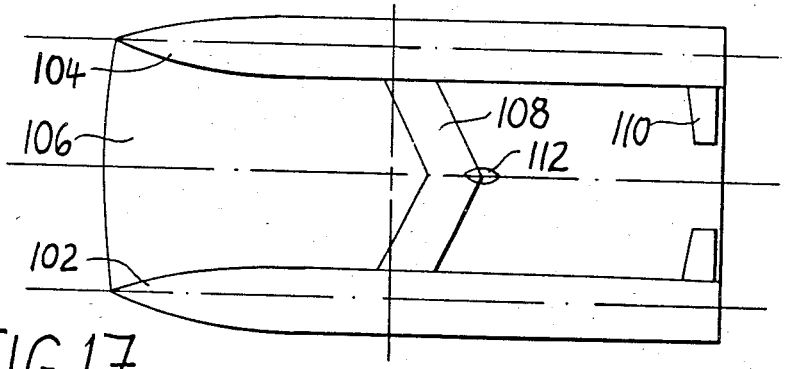
FIG.17
FIG.18
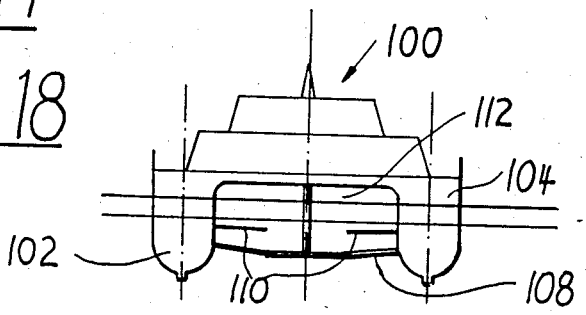

CATAMARAN WITH HYDROFOILS

FIELD OF INVENTION

The present invention relates to boats.

More particularly, the invention relates to boats with "hydrofoil-supported-ship hulls", briefly referred to as "HYSUHULLS". In contradistinction to hydrofoil craft, which "fly" on hydrofoils, when at speed the HYSUHULLS are ship hulls equipped with hydrofoils along the underwater part of the ship, which hydrofoils develop lift forces at speed which take over a part only of the ship's weight force. Thereby the hull (or hulls) are lifted partly out of the water to reduce the ship-hull-resistance. As the lift carrying efficiency of the hydrofoil at the higher speed is much better than the one of the hull, the overall resistance of the HYSUHULL is reduced. The hull (or hulls for multi-hull vessels) carries the full shipweight at rest or low speed by buoyancy forces, and at higher speeds partly by buoyancy forces and partly by dynamic hull forces (planing forces) and by the hydrofoil lift forces.

BACKGROUND TO INVENTION

The HYSUHULL principle can be applied to any ship hull, monohull, catamaran hulls or multi-hull vessel. A special advantage is gained when the principle is applied to catamaran hulls, in short called HYSUCAT. Here it allows a most suitable and compact ship construction. The foil is arranged in the gap between the two demihulls, and is well protected by the hulls. The strength of the catamaran is increased by the foils near the keel line forming a ringlike frame structure connecting the two demihulls to each other. The deck covers the two demihulls and the tunnel gap. The necessary foil area to carry a portion of the ship weight (eg. 50%) is dependent, in addition to the other parameters involved, on the square of the ship speed ($V^2$). Therefore for high speed ships it is much smaller than for low speed hulls. This influences the tunnel width. In speed ranges of usual planing craft, the necessary tunnel width is relatively small allowing HYSUCAT designs with similar hull proportions as deep-V-planing craft. The high speed catamaran is best equipped with fully asymmetrical demihulls, which allow a straight tunnel with parallel vertical side walls and low flow interference effects inside the tunnel.

The nval architect uses a dimensionless speed, defined as the Froude displacement number $$F = \frac{V}{\sqrt{g \cdot \nabla^{\frac{1}{3}}}}$$

with V=ship speed, g=acceleration of earth, $\nabla$=displaced volume.

For very low $F_{n\nabla}$ the usual displacement hull is the most efficient (say up to $F_{n\nabla}=2,3$) but has to be built extremely slender for the higher speeds to be efficient. The HYSUCAT is more efficient for $F_{n\nabla} \geqq 2,3$ compared with mono displacement hulls and planing deep-V-craft. When compared with a planing-deep-V-craft, the HYSUCAT is more efficient from $F_{n\nabla} \geqq 1,6$ under the consideration of a compact structure (excluding extreme L/B proportions).

For HYSUCAT craft designed for the lower speeds, but $F_{n\nabla} \geqq 1,6$, the use of partly asymmetrical demihulls or symmetrical demihulls may be advantageous, however for much lower $F_{n\nabla}$ values the necessary support-hydrofoil area will have to be relatively large and a part of the resistance gain is lost in higher friction resistance over the foil. The HYSUCAT cannot improve on the low speed displacement hull, especially if it is a comparable monohull.

The HYSUCAT therefore has primarily to be considered as a "High Speed Small Craft". None of the prior patents or patent applications known to the applicant resulted in the building of a practical HYSUCAT craft. This is mainly due to the fact that none of the proposed designs allowed the combination of the hull and support hydrofoils without negative interference of each other, which results in either a high resistance or insufficient trim and transverse stability especially at speed.

According to the invention, a catamaran type boat is provided having two similar boat demi-hulls which are spaced apart and which are substantially parallel, each demi-hull having a base line (BL) extending longitudinally tangentially to the lowest boundary of the surface of the demi-hull at the midship ordinate, the boat further including (a) a superstructure conecting the two demi-hulls transversely;

(b) an open space in the form of a tunnel defined between the superstructure and the two demi-hulls;

(c) a longitudinal centre of gravity position (LCG) for the boat;

(d) at least one main hydrofoil, having a cord line (CL) extending between its leading edge and trailing edge and extending at least partially across the tunnel, and being adapted to be under water;

(e) at least one trim hydrofoil having a chord line (CL) extending between its leading edge and trailing edge and being located in the stern region of the boat and extending at least partially across the tunnel; the projected area of the main hydrofoil being larger than the combined projected area of all trim hydrofoils; and (f) attachment means for attaching all hydrofoils to the demi-hulls substantially along a transverse plane (TP), which is substantially at right angles to the longitudinal vertical centre plane of the boat, and having an angle of between 1° and 7° to the base line (BL) of the demi-hulls at the main foil, and with the hydrofoil chord lines (CL) being at an angle of between 0° and 6° to the transverse plane (TP), the attachment means being adapted to locate the hydrofoils such that their combined resultant lift-force at speed is adapted to act lengthwise through a point in the vicinity of the longitudinal centre of gravity (LCG).

The main hydrofoil may be located substantially in the vicinity of the LCG of the boat, and the superstructure may be adapted to be above water when the boat is at speed.

The attachment means may locate each hydrofoil such that at highest speed the average water height (HW) over it is less than the main hydrofoil chord length (CL) and preferably being 20% to 50% thereof.

The projected area of the main hydrofoil may be about 3 to 5 times larger than the combined projected area of all trim hydrofoils.

The hydrofoils in the transverse plane may have a leading edge which has a slight dihedral angle.

The hydrofoils may be built up of subcavitating foil-profile-sections with a circular upper surface and a flat lower surface and a rounded leading edge, or the hydrofoils may be built up of supercavitating foil-profile-sections with wedge-like shape, sharp leading edge and blunt trailing edge.

The demi-hulls may be of the fully assymetrical planing hull type, preferably with deep-V planing hull characteristics.

The demi-hull side walls facing towards each other may be substantially flat and substantially straight forming a substantially straight tunnel in flow direction with about vertical parallel tunnel side walls.

The attachment means may attach each main hydrofoil near and slightly above the base line (BL) of each demi-hull.

The superstructure connecting the two demi-hulls may include a tunnel ceiling, which is watertight and which is located at a position to come into water contact when the boat is at rest or moves at low speeds.

At least one main hydrofoil may extend fully across the tunnel and at least one pair of trim hydrofoils extends partially across the tunnel.

Height adjustment means may be provided for adjustment of the height of the trim foil(s) over keel, in order to adjust or change the trim-angle of the boat at speed.

Angle adjustment means may be provided to adjust the angle of attack of the foils towards the hulls.

The invention therefore attempts to improve on the disadvantages of prior hull foil arrangements and purposes a double foil arrangement, which has self-trimming characteristics. Therefore the positioning of LCP (longitudinal centre of pressure of foil) in relation to LCG (longitudinal centre of gravity of craft) is less critical. The boat therefore should function properly and efficiently in the full range of all practically possible LCG positions, which is especially important for the smaller and less complicated boats. To achieve this at least two support hydrofoils must be arranged in such way as to contribute to the longitudinal stability of the craft. This is possible, in accordance with the invention, by fitting the foils to the hull in such positions that the foils operate at design speed in surface nearness, which results in reduced lift forces. The foil's lift in the so-called "surface effect" is dependent on a further parameter, the height of water over the foil (HW) in relation to the foil's chord length (CL). The foil starts to "feel" the surface when the ratio HW/CL=1,0. For smaller ratios HW/CL the lift force falls off and it reaches a value of about 50% when the foil's leading edge breaks the surface. The lift forces reduce with further emergence until they are zero when the foil's trailing edge leaves the water (the second stage is similar to planing).

From the test results it followed that the foil should be operational at design speed in the surface effect for values of HW/CL=0,15 to 0,4 with the lift force being reduced to about 32% to 54% of its value when fully submerged. However, operation is also possible when the top surface of the one or the other foil, or both foils, is free of water contact and the lower foil surface acts like a planing surface. At this stage the efficiency is reduced but at high speeds it may be acceptable.

A support hydrofoil designed to operate in the surface effect mode in the tunnel of the catamaran boat under discussion brings the advantage that the foil with a specific load shows the tendency to run at a constant level of submergence. If it is pushed deeper into the water, it will develop strongly increasing lift-forces, which tend to bring it back to the design level. The increase of the lift forces, due to surface effect, are independent of the attack angle. The foil surface effect gives therefore an alternative way of regulating the lift forces without changing the trim angle of the boat, simply by submergence and this can be used to stabilise the boat longitudinally and also partly transversely.

As stated above in order to achieve this objective, in accordance with the invention, the catamaran has at least two foils fitted, a main foil slightly in front of LCG and a trim foil (or foil pair) behind the LCG near to the stern. The foils can have different projected areas, and different distances to the LCG position of the craft, for example a special advantage is reached with a larger main foil slightly in front of LCG and a small trim foil near the stern of the craft. The resultant lift force of all foils in the design and optimum conditions must act through a centre of pressure near the LCG to allow a favourable trim of the boat at all speeds. It is not practical to fit the main foil too far ahead of the LCG position (say near the bows) as it would "suffer" the strongest trim motions there, and leave the water in waves periodically with hard impact motions. It therefore is advantageous to have the main foil as near as possible to the LCG position, so that the trim balance can be maintained at all speeds. This means that the trim foil (or foil pair) with the longer distance to the LCG position has to be as small as possible but large enough to fulfill the trim balancing job, which depends on the LCG shifts to be expected during operation. On a smaller boat the LCG shift is stronger and relatively larger trim foils will be required which "force" the main foil positioning forwardly so that the resultant lift force of all foils acts at or near the LCG position.

Further, if the foil would penetrate deeper than the lateral area of the hull, this would render the foil vulnerable to contact with floating objects, structures at sea bottom or harbour installations. It is rather more favourable to have the foils inside the protected tunnel space.

The foils must be dimensioned to carry the part load (they are supposed to take) of the craft's weight in the surface effect mode. This means, their areas must be, based on the above explanations, larger by the factor of the lift reduction in surface effect for design speed. They must then be fitted in the inside of the tunnel of the two demihulls in such a way that they come at design speed in the desired surface effect position and in the meantime allow the demihulls to run partly submerged with a favourable or optimum trim angle $\psi$. It means the foils must be fitted to the demihulls in a way that they have about the same depth of submergence (preferably HW/CL=0,15 to 0,4) when the hull is running with a favourable or optimal trim at design speed. The forward foil is positioned deeper towards the demihull keel and in most cases just slightly above keel height whereas the stern foils are situated higher above the keel line. The foils operate in the surface effect mode and have about optimal attack angles $\alpha_{1,2}$ towards the inflow, the hull has a favourable or optimal trim angle $\psi$. In this way the resistance improvement is optimal.

The invention will now be described by way of example with reference to the accompanying schematic drawings.

In the drawings there is shown in

Figure 2A:
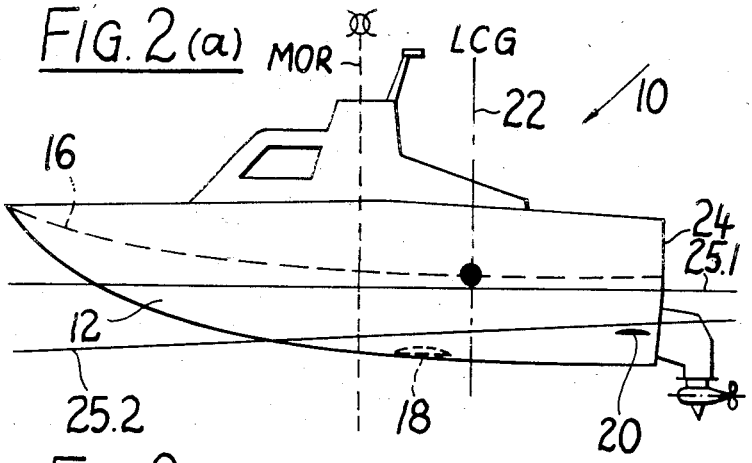
Figure 2B:
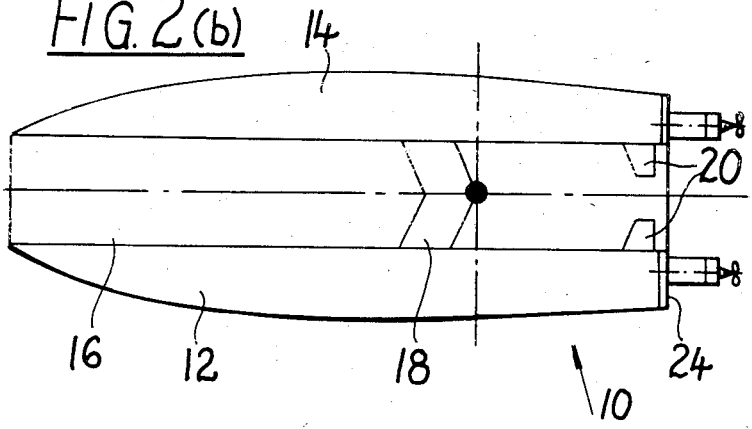
Figure 2C:
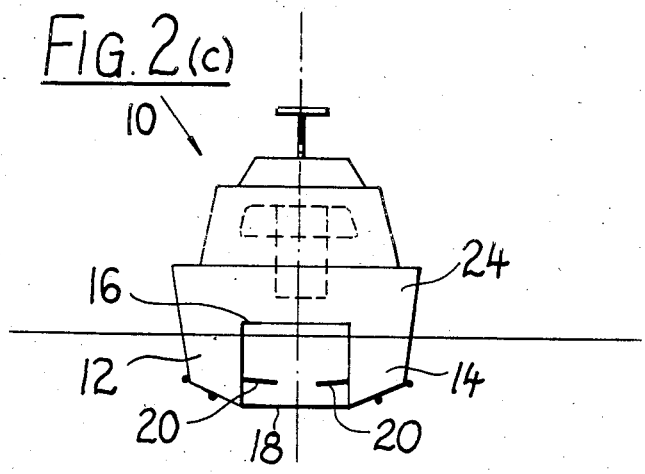
Figure 9:
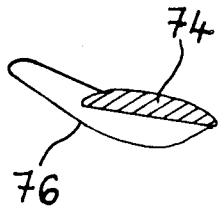
Figure 14:
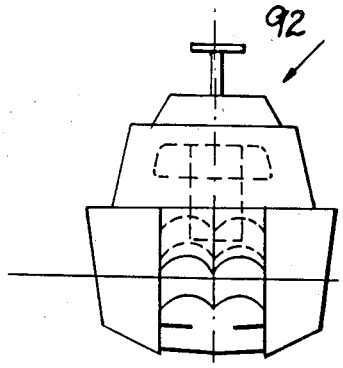
Figure 19:
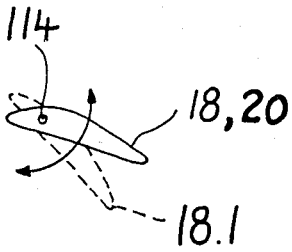

FIG. 1 schematically a side view of part of a boat for explaining the terminology used;

FIGS. 2*a*, 2*b*, 2*c* respectively a side view, a plan view and a rear view of a boat provided with hydrofoils in accordance with the invention;

FIG. 3 a sectional side view, on a larger scale of one type of hydrofoil profile section;

FIG. 4 a sectional side view of a second type of hydrofoil profile section;

FIGS. 5*a*, 5*b*, 5*c*, 5*d*, 5*e*, 5*f* plan views of various shapes of hydrofoils;

FIGS. 6*a*, 6*b*, 6*c*, 6*d* front views of various shapes of hydrofoils;

FIG. 7 a plan view of a boat provided with hydrofoils, which do not extend fully across the tunnel;

FIG. 8 a plan view of a hyfrofoil provided with spoilers;

FIG. 9 on a larger scale a sectional side view of a hydrofoil seen along arrows IX—IX in FIG. 8;

FIG. 10 a side view of a second embodiment of a boat in accordance with the invention;

FIG. 11 a sectional view of a third embodiment of a boat in accordance with the invention;

FIG. 12 a side view of a fourth embodiment of a boat in accordance with the invention;

FIG. 13 a view from below of the boat seen along arrow XIII in FIG. 12;

FIG. 14 a rear view of the boat seen along arrow XIV in FIG. 12;

FIG. 15 a schematic side view of a boat hull in accordance with the invention and at speed to explain basic principles;

FIG. 16 a side view of a fifth embodiment of a boat in accordance with the invention;

FIG. 17 a view from below of the boat seen along arrow XVII in FIG. 16;

FIG. 18 a rear view of the boat seen along arrow XVIII in FIG. 16;

FIG. 19 a detail of a hydrofoil angular adjustment; and

Figure 20:
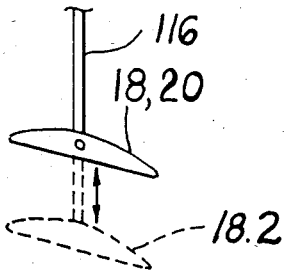

FIG. 20 a detail of a hydrofoil height adjustment.

Referring to FIG. 1 a side view of part of a boat hull in accordance with the invention is shown in order to explain certain terminology used in the specification and claims.

The same reference numerals will be used to indicate similar parts as in FIGS. 2*a*, 2*b*, 2*c*.

The boat hull 12 (or 14) has a main hydrofoil 18 and a trim hydrofoil 20. These hydrofoils have chord lengths or lines $CL_1$ and $CL_2$ respectively. The boat hull has a lowest boundary line 11. As stated in "Principles of Naval Architecture" (Editor: John P. Comstock, published by the Society of Naval Architects and Marine Engineers New York, 1967, at p 4, lines 3 ff):

"Where this lowest boundary line intersects the mid-ship-section ordinate, a point is determined through which a horizontal plane is passed, known as the molded base line, and abbreviated as BL . . . . This is a very important datum line for many ship calculations as well as for use during the construction of the vessel."

In the present instance the base line BL is taken to be a horizontal plane which is tangential to the lowest boundary line 11 in the region of the main foil 18 at the mid-ship ordinate MSO.

Furthermore, a transverse plane TP is defined which passes trough the centres of both the main hydrofoil 18 as well as the trim hydrofoil 20 and which is substantially at right angles to the longitudinal vertical centre of the boat.

Finally, the longitudinal centre of gravity line (LCG) of the boat is indicated by reference LCG and is located between the main foil 18 and the trim foil 20.

Referring now to FIGS. 2*a*, 2*b*, 2*c*, a sea going planing catamaran boat 10 having two separate substantially parallel boat hulls 12 and 14 with a tunnel 16 inbetween is shown to be provided with two hydrofoils 18 and 20 in accordance with the invention.

As is shown, the major or front hydrofoil 18 is located substantially at the LCG line 22 of the boat. The minor or rear hydrofoil 20 is provided substantially at the stern area 24 of the boat 10, all foils are in water contact when the boat is at speed. The waterline at rest is shown by reference numeral 25.1, and at speed by reference numeral 25.2.

Referring to FIG. 3, the hydrofoil 18, 20 is shown to have a profile with a flat underside 26 and curved upper surface 28. The flat underside 26 facilitates construction, whereas the curved upper side 28 may be similar to the NACA profiles or circular back profiles as used on marine screw propellers. It must be noted that any efficient hydrofoil profile section can be used.

In FIG. 4 a different type of super cavitating profile hydrofoil section is shown. Here the underside 30 is flat or slightly concave. The upper surface 32 and the underside 30 together define a wedge-like shape for high speed applications as in supercavitating marine screw propellors.

In FIGS. 5*a*, 5*b*, 5*c*, 5*d*, 5*e*, 5*f*, in plan view various shapes of hydrofoils are shown which can be main or trim foil shapes or different combinations thereof. This is in addition to the shape of the foil in FIGS. 2*a*, 2*b*, 2*c*. The direction of travel is indicated by means of an arrow in each case. In FIG. 2*b* the first hydrofoil 18 has a backward sweep, whereas in FIG. 5*a* the next hydrofoil 36 has a forward sweep. The hydrofoil 38 (FIG. 5*b*) has a forward curvature with hydrofoil 40 (FIG. 5*c*) provided with a rearward curvature.

The hydrofoils 18 and 36, 38, 40 are shaped for improved seakeeping when breaking the surface, smoother flow over the foils in waves and reduced onset of cavitation.

The hydrofoil 42 (FIG. 5*d*) has a backward sweep on the front edge with a taper on the rear edge.

The hydrofoil 44 (FIG. 5*e*) is substantially similar to hydrofoil 18 but with a narrowed portion on the centre.

The hydrofoil 46 (FIG. 5*f*) in turn is also similar to the hydrofoil 40 but also provided with a narrow central section.

The hydrofoils 42, 44, 46 are for higher lift loads near the side hulls for increasing the transverse stability.

Referring to FIGS. 6*a*, 6*b*, 6*c*, 6*d*, front views of various hydrofoils are shown which can be main or trim foils or combinations thereof. The hydrofoil 48 (FIG. 6*a*) has a downward shape with a central valley 50, wheras the hydrofoil 52 (FIG. 6*b*) has an upward shape with an apex or peak 54. The dihedral angles or curvatures are relatively small.

The hydrofoil 56 (FIG. 6*c*) is curved downwardly and the hydrofoil 58 (FIG. 6*d*) curved upwardly. The hydrofoils 48, 52, 56 and 58 provide for better strength improved flow in waves, especially if combined with one of the shapes of the foils 18, 36, 38, 40, 42, 44, 46.

In FIG. 7 an arrangement is shown where the hydrofoils do not extend fully across the tunnel 60 between the two hulls 62 and 64. The front hydrofoil is constituted by two similar sections 66 and 68 whereas the rear hydrofoil comprises sections 70 and 72.

Any of the above hydrofoils may be constituted by a number of hydrofoils provided parallel and fairly close to each other.

Where the boat is operated in water where objects can hit the foils, it is advisable to provide suitable protection as is shown in FIGS. 8 and 9. Here spoilers 76 are fitted to the foil 74, for instance. The spoilers 76 are spaced apart and extend over the full bottom width and partly over the top width of the foil 74. The spoilers 76 preferably have a streamlined shape in flow direction, and are rounded on the inflow side.

For fast seagoing craft of the type considered it is desired that the forward positioned foil, namely the main foil, shall be positioned longitudinally as far astern as possible for better seakeeping in waves. This means that the extreme forward position of LCG (as mentioned above) must be relatively far astern which often is not possible and will give the ship a too large trim angle when floating or moving at very low speeds. The hull resistance would then be undesirably high at lower speeds. It is therefore proposed according to this invention to give the stern end of the planing areas of the demi-hulls a so-called "rocker", which means an upward curvature resulting in a convex shape of the end of the planing area, which otherwise is straight (see FIG. 10). The "rocker" tends to increase the trim angle at speed and the resultant lift force of the support hydrofoils has to be positioned further astern to compensate for the nose-up trim moment caused by the low pressure fields around the rocker. The boat 78 of FIG. 10 is shown to have a main foil 80, a trim foil or foils 82 and a rocker radius 84. A very slight "rocker" radius, which is hardly visible, can allow the main support hydrofoil installation to be positioned considerably astern. The main foil then takes a higher load to compensate for the rocker trim moment. It has a higher efficiency than the demi-hull and by holding the boat at the desired trim, the demihull wake is reduced which should result in a reduction of the overall resistance of the craft. The rocker, therefore, offers three advantages; it reduces the overall resistance, it allows the installation of the main hydrofoils further astern, which is good for seakeeping, and it reduces the nose-down trim action of the boat when the ship at speed breaks through a wave crest with its stern part.

Another method of achieving astern positioned foil arrangements and resistance reduction at high speeds, is by designing a step at the stern end of the planing areas of the demi-hulls in a new way as indicated in FIG. 11. Here the boat 86 has two similar hull parts 88 of which one is shown in sectional side view. The planing area step 90 is shown by the line A-B, starting at the stern at B and ending on the chine at A. The area ABC is inclined upwards in the sketch and gives the defined flow break off line AB. The area ABC will be free of water contact at speed as the waterflow will break off along the sharp edge line AB which reduces the wetted area at speed and the high speed frictional resistance. The ventilated stern area does not contribute dynamic lift force and a large trimangle is achieved, which is balanced by the installation of the main support hydrofoils slightly sternwise as is shown.

The bridge like structure connecting the two demihulls, as shown in FIGS. *2a, 2b, 2c,* is horizontal and nearly flat, situated above the water level. In waves or if overload is carried, the tunnel ceiling may come in water contact constantly or periodically. The flat areas of the tunnel ceiling then create hard impact forces. An improved shape of the tunnel ceiling according to the invention is indicated in principle in FIGS. 12, 13 and 14. Here the boat 92 has a symmetrical twin concave tunnel ceiling straight down in longitudinal direction with a slightly larger angle of attack towards the inflow than the hull planing areas, and acting as a planing surface at speed with the flow-break-off edge E near the LCG position (slightly behind) to prevent undesirable trim moments when accelerating the craft from standstill to planing speed. At rest the boat sinks deeper into the water as the whole weight must be carried by buoyancy forces and then the tunnel ceiling carries a part of the buoyancy weight, thus allowing a higher load carrying capacity of the craft. At speed the hulls are partly lifted up and the whole of the tunnel ceiling becomes free from water contact.

In heavy seas and at medium speeds, the tunnel ceiling comes periodically in contact with water and, due to the concave shape, the impact forces are reduced and the boat is lifted up more gently than for the flat-area ceiling. The trim concave arrangement ensures transverse stability when running through waves at an angle to the crest line.

It must be stressed that the special foil arrangement of the main and the trim foil in the design of a HYSUCAT in accordance with the invention is absolutely critical if the craft is to be autostable due to foil surface effect in the full speed range for longitudinal shifts of the centre of gravity. To explain this requirement, reference is to be made to the explanation following below. FIG. 15 shows the arrangement of a catamaran boat hull 94 with a main foil 96 having the chord length $CL_1$ on the inside of the tunnel wall. The trimangle is "overdimensioned" in the sketch for easier understanding. (Favourable trimangles for planing type hulls are in the range of 3° to 6° with the average at about 4,5°. ). The distance between the lift force location of the main foil 96 and the trim foil 98 is indicated as $\Delta l$. The indicated foil profile sections present transversewise average positions. The vertical distances of the foils above the base line are $hk_1$ and $hk_2$. The water heights, namely $HW_1$, $HW_2$ over the foils at design speed, have to be smaller than the foil chord length in order to make use of the "surface effect". It was found by way of tests that the foil efficiency is only reduced for values of $\kappa < 0{,}3$, wherein $\kappa$ is defined by $\kappa = HW/CL$. The lift reduction, due to surface effect for $\kappa = 0{,}3$, is about $L_{surface}/L_{\infty} = 0{,}5$ (still slightly dependent on profile section shape and attack angle $\alpha$).

The main foil 96 is attached to the hulls 94 slightly forward of the LCG position and a small distance above the keels to protect it from ground contact. The trim foil 98 near the stern is attached at a greater distance above the keel at a vertical distance $hk_2$ to make use of foil surface effect for trim stabilisation. This distance is based on the formula $$hk_2 = hk_1 + \Delta l.(\tan\psi - \tan\theta) + \kappa_1.CL_1 - \kappa_2.CL_2 \qquad \text{Equ. 1}$$

can be seen from FIG. 15, $\theta$ being the angle of the water level deflection inside the tunnel due to the action of the main foil and flow interference effect between the two demihulls inside the tunnel. ($\theta$ is a relatively small angle of 1° to 2° if the specific load on the main foil 96 is not excessively high and the main foil operates near optimum. In HYSUCAT designs with large tunnel it could be neglected. $\theta$ can become negative (rising water level), for example when the tunnel is narrower at the stern).

The value of $\kappa$ expresses the foil's surface nearness at speed and preferably must have a value of about 0,3 for good foil efficiency and strong trim stabilisation effect. Smaller values of $\kappa = 0{,}3$ result in slight resistance increases but increased trim stability especially for LCG shifts astern: at such values there would be harder run in waves as the hull tends to follow the surface more stiffly. Values of $\kappa$ up to about 0,5 are possible with lower trim stabilising effect but with higher foil efficiencies and resulting in smoother rides in waves. The resultant lift force of all the foils must act approximately through the LCG position, which means the trim foil must be dimensioned as small as possible, just to fullfill its stabilising role (not so much to carry load) in order not to "force" the main foil in the design too far forward.

For reasons of seakeeping in waves the main foil must be as far astern as possible.

The foils are dimensioned to carry a part of the load of the ship (say about 40% to 60%) and their areas are increased corresponding to the lift reduction due to surface effect.

HYSUCAT craft in accordance with the invention designed to operate at lower Froude numbers $$(F_{n\nabla} = V/\sqrt{\nabla^{\frac{1}{3}} \cdot g.})$$

in the range of $1{,}3 < F_n < 2{,}5$ (one example: 30 m craft with V=25 knots) have a relatively higher wave-making resistance than the above mentioned high speed HYSUCATS and must therefore be equipped with demihulls of the semi-displacement type (partly planing, partly buoyancy supported, symetrical or partly assymetrical).

A typical symetrical type of demihull is indicated in principle in FIGS. 16, 17, 18. Such catamarans 100 have in general more slender hulls 102, 104 and the tunnel 106 is wider to prevent unfavourable interference of flow between both demihulls. The support hydrofoils 108, 110 are relatively larger in relation to the demihull dimensions than for the high speed craft (because the foil lift depends on $V^2$). To allow main foils 108 with the large spanwidth, a middlestrut 112 is provided, which is placed in the centre plane on the swept foil at the trailing edge in order not to disturb the low pressure regions of the foil near the leading edge. The strut is streamlined and rigidly connected to the tunnel ceiling. The trim foil can be reinforced in a similar manner.

The foil arrangement of the main foil 108 and trim foils 110 follows the principles as explained for the high speed craft. However, the semi-displacement hull is not planing with its foreward hull portions and the foil is attached relatively higher above the keel to come in surface effect when the hull is partly lifted out of the water at speed. The distance $hk_1$ is somewhat larger for these craft. The trim foil 110 is attached near the stern corresponding to the above formula Equ. 1 to operate in the desired surface effect mode at design speed and produce the desired trim ability at speed and to keep the demihulls at the most favourable trim angle. The main foil is much larger than the trim foil and carries the main foil load. It is attached to the hulls so that its lift force acts near the LCG position, depending on the hull trim characteristics either slightly in front, if hull trim is very low, or otherwise slightly astern of the LCG position. The main foil can have any of the above discussed foil shapes but preferably a slight sweep of 10° to 30° and a very small dihedral angle of about 3° to 5° to allow a smooth undisturbed flow over the foil even if it operates in waves very near the water surface or sometimes breaks the surface periodically. It must be adapted to the hull wall inclination. The smaller trim foils near the stern can be a pair of strutfoils as indicated in FIG. 15 or one single foil spanning the tunnel width with a middle strut similar to the main foil.

In the transverse section (FIG. 7) the foils must be located substantially at right angles to the inner tunnel wall in order to allow an undisturbed flow along the hull and positive interference between foil and hull flow. However, in the case of the semi-displacement type catamaran the tunnel walls are not necessarily vertical in the attachment area. By designing in such proportions that the foils carry about 40% to 60% of the craft's weight at design speed, a resistance improvement of about 30% to 40% can be expected due to the support foils, which makes the craft more efficient than a comparable monohull.

The semi-displacement type HYSUCAT would be suitable for sailing boat designs, for which the foils should have slightly higher dihedral angles and the trim foil will have to be dimensioned stronger. The keel weight could be placed at the centre plane held by the foils.

In FIG. 18 angular adjustment means is shown to enable a foil 18 (or 20) to be pivotted about a shaft 114 into another position 18.1 so as to vary the angle of attack of the foil. The adjustment may be done mechanically, electrically or pneumatically.

In FIG. 19, height adjustment means is shown for allowing a foil 18 (or 20) to be adjusted upwardly or downwardly into a position 18.2. Here the foil can be mounted on a slide which is moved vertically.

I claim:

1. A catamaran type boat having two similar boat demi-hulls which are spaced apart and which are substantially parallel, each demi-hull having a base line (BL) extending longitudinally tangentially to the lowest boundary of the surface of the demi-hull at the midship ordinate, the boat further including:

(a) a superstructure connecting the two demi-hulls transversely;

(b) an open space in the form of a tunnel defined between the superstructure and the two demi-hulls;

(c) a longitudinal centre of gravity position (LCG) for the boat;

(d) at least one main hydrofoil, having a chord line (CL) extending between its leading edge and trailing edge and extending at least partially across the tunnel, and being adapted to be under water; said main hydrofoil being located substantially in the vicinity of the LCG;

(e) at least one trim hydrofoil having a chord line (CL) extending between its leading edge and trailing edge, said trim hydrofoil being located in the stern region of the boat and extending at least partially across the tunnel; the projected area of the main hydrofoil being 3 to 5 times larger than the combined projected area of all trim hydrofoils; and (f) attachment means for attaching all hydrofoils to the demi-hulls substantially along a transverse plane (TP), which is substantially at right angles to the longitudinal vertical centre plane at the boat, and having an angle between 1° and 7° to the base line (BL) of the demi-hulls at the main foil, and with the hydrofoil chord lines (CL) being at an angle of between 0° and 6° to the transverse plane (TP), the attachment means being adapted to locate the hydrofoils such that their combined resultant lift-force at speed is adapted to act lengthwise through a point in the vicinity of the longitudinal centre of gravity (LCG) and wherein said attachment means locates each hydrofoil such that at highest speed the average water height is 20% to 50% of the chord length.

2. A boat as claimed in claim 1, in which the superstructure is adapted to be above water when the boat is at speed.

3. A boat as claimed in claim 1, in which the hydrofoils are straight in horizontal plan in span width direction.

4. A boat as claimed in claim 1, in which the hydrofoils have a backward sweep in the horizontal plan width direction.

5. A boat as claimed in claim 1, in which the hydrofoils in the transverse plane have a leading edge which is straight.

6. A boat as claimed in claim 1, in which the hydrofoils in the transverse plane have a leading edge which has a slight dihedral angle.

7. A boat as claimed in claim 1, in which the attachment means attaches the hydrofoils at an angle of about 90° seen with the transverse plane to the surface of the inner tunnel side walls of the demi-hulls.

8. A boat as claimed in claim 1, in which the hydrofoils are built up of subcavitating foil-profile-sections with a circular upper surface and a flat lower surface and a rounded leading edge.

9. A boat as claimed in claim 1, in which the hydrofoils are built up of supercavitating foil-profile-sections with wedge-like shape, sharp leading edge and blunt trailing edge.

10. A boat as claimed in claim 1, in which the hydrofoils are provided in pairs, namely one hydrofoil substantially vertically and parallel above the other.

11. A boat as claimed in claim 1, in which the demi-hulls are of the fully assymetrical planing hull type, preferably with deep-V planing hull characteristics.

12. A boat as claimed in claim 1, in which the demi-hull side walls facing towards each other are substantially flat and substantially straight forming a substantially straight tunnel in flow direction with about vertical parallel tunnel side walls.

13. A boat as claimed in claim 1, in which the attachment means attaches each main hydrofoil near and slightly above the base line (BL) of each demi-hull.

14. A boat as claimed in claim 1, in which the superstructure connecting the two demi-hulls includes a tunnel ceiling, which is watertight and which is located at a position to come into water contact when the boat is at rest or moves at low speeds.

15. A boat as claimed in claim 14, in which the tunnel ceiling consists of two similar upwardly curved areas meeting each other in the longitudinal centre plane of the boat.

16. A boat as claimed in claim 14, in which the tunnel ceiling has a triangular shape its apex located substantially in the longitudinal centre plane of the boat.

17. A boat as claimed in claim 1, in which at least one main hydrofoil extends fully across the tunnel and at least one pair of trim hydrofoils extends partially across the tunnel.

18. A boat as claimed in claim 1, in which a streamlined vertical middle strut is provided connecting at least one main hydrofoil near the trailing edge to the tunnel ceiling in the boat's longitudinal centre plane for support of the hydrofoil in span width direction.

19. A boat as claimed in claim 1, in which height adjustment means is provided for adjustment of the height of the trim foil(s) over keel, in order to adjust or change the trim-angle of the boat at speed.

20. A boat as claimed in claim 1, in which angle adjustment means is provided to adjust the angle of attack of the foils towards the hulls.

* * * * *